US007134761B2

(12) United States Patent
Francke

(10) Patent No.: US 7,134,761 B2
(45) Date of Patent: Nov. 14, 2006

(54) ARRANGEMENT AND A METHOD FOR EMITTING LIGHT

(75) Inventor: Tom Francke, Sollentuna (SE)

(73) Assignee: Light-Lab AB, Goteborg (SE)

( * ) Notice: Subject to any disclaimer, the term of this patent is extended or adjusted under 35 U.S.C. 154(b) by 188 days.

(21) Appl. No.: 10/498,315

(22) PCT Filed: Dec. 10, 2002

(86) PCT No.: PCT/SE02/02271

§ 371 (c)(1),
(2), (4) Date: Oct. 22, 2004

(87) PCT Pub. No.: WO03/054902

PCT Pub. Date: Jul. 3, 2003

(65) Prior Publication Data

US 2005/0062413 A1 Mar. 24, 2005

(30) Foreign Application Priority Data

Dec. 11, 2001 (SE) ..... 0104162

(51) Int. Cl.
*F21V 9/16* (2006.01)

(52) U.S. Cl. ..... 362/84; 362/263; 362/260; 313/594; 250/382

(58) Field of Classification Search ..... 362/260, 362/84, 263, 37, 464, 466, 465, 523, 427, 362/40, 41; 250/385.1, 372, 374, 382; 313/231.31, 313/558, 310, 496, 594, 601, 595; 701/49; 340/468, 475, 476, 477
See application file for complete search history.

(56) References Cited

U.S. PATENT DOCUMENTS

| | | | | |
|---|---|---|---|---|
| 3,774,029 | A * | 11/1973 | Muntz et al. | 378/30 |
| 4,156,140 | A * | 5/1979 | Lafferty et al. | 378/31 |
| 5,223,717 | A | 6/1993 | Charpak | |
| 5,905,334 | A | 5/1999 | Nakamuar et al. | |
| 6,365,902 | B1 * | 4/2002 | Francke et al. | 250/382 |
| 6,627,897 | B1 * | 9/2003 | Francke et al. | 250/385.1 |
| 6,707,251 | B1 * | 3/2004 | Chow et al. | 313/594 |

FOREIGN PATENT DOCUMENTS

| | | |
|---|---|---|
| EP | 0 042 746 B1 | 6/1986 |
| EP | 0 443 865 A1 | 8/1991 |
| EP | 0 450 571 A2 | 10/1991 |

* cited by examiner

*Primary Examiner*—Thomas M. Sember
(74) *Attorney, Agent, or Firm*—Harness, Dickey & Pierce, P.L.C.

(57) ABSTRACT

An arrangement for emitting light includes a hermetically sealed casing with a window, a layer of a fluorescent substance arranged within the casing covering at least a major part of the window, an electron emitting cathode arranged within the casing, and an anode. The casing is filled with a gas suitable for electron avalanche amplification. In operation, the cathode and anode are held at an electric potential such that said emitted electrons are accelerated and avalanche amplified in the gas. The layer of the fluorescent substance is arranged to emit light through the window in response to avalanche amplified electron bombardment and/or ultraviolet light emitted from the gas.

28 Claims, 3 Drawing Sheets

ARRANGEMENT AND A METHOD FOR EMITTING LIGHT

FIELD OF INVENTION

The present invention generally relates to cathodoluminescent light sources. More particularly, the invention relates to an arrangement and a method for emitting light by use of electron emission cathodes and fluorescent substances.

BACKGROUND

One type of a light source is the fluorescent tube. In the fluorescent tube a gas discharge emits ultraviolet (UV) light onto a fluorescent material. The light source suffers from serious drawbacks. For instance, there is always a delay after the power has been turned on until the light source radiates at full power. Further, it needs complicated control equipment, which requires space and adds cost. Also, it is unfortunately necessary to use material having negative environmental effects, such as mercury. Furthermore, the choice of fluorescent material is limited to UV-sensitive materials. Most of these fluorescent materials emit light of a spectral shape, which is not optimal for the eye and human comfort. Finally, this kind of light source is often rather temperature sensitive in that the emission intensity is significantly weaker for a long time after switch-on at low temperatures compared to at high temperatures.

Another type of light source is the cathodoluminescent light source. In a cathodoluminescent light source electrons are emitted from a cathode either by heating the cathode, thus thermally emitting the electrons, or by employing a strong electric field in the vicinity of the surface of the cathodes, thus emitting electrons through field emission.

Examples of field emission cathode light sources employing a strong electric field in the vicinity of the surface of a cathode are disclosed in U.S. Pat. Nos. 5,877,588 and 6,008,575.

The main drawback of a thermally emitting cathode is that large amounts of energy are lost in heating the cathode. The main drawback of both field and thermal emission cathodes is that high emission currents cause the cathode to wear out as all electrons producing the light have to be emitted from the cathode. This implies that a high electron current has to be emitted from the surface of the cathode, which complicates the cathode structure and production thereof. Further, the current cathodoluminescent light sources only operate in vacuum, which requires thick walls around the light source.

SUMMARY OF THE INVENTION

An object of the present invention is to provide an improved light source and method, respectively, which provide brighter light compared to prior art light sources, and which lack at least some of the drawbacks described above.

This object, among others, is according to the present invention attained by arrangements and methods, respectively, as defined in the appended claims.

By providing a gas suitable for electron avalanche amplification in a cathodoluminescent light source brighter light can be achieved. Furthermore, the emission current from the cathode is reduced as a majority of the electrons are liberated from the gas and not emitted from the surface of the cathode, which simplifies the construction of the cathode and prolongs its life time.

As the pressure in a gas-filled light source is considerably higher than vacuum, typically atmospheric pressure, the walls of the light source can be made thinner, which makes the light source lighter.

As during the avalanche amplification, besides electrons, also UV light is emitted that may stimulate the fluorescent material, causing it to emit light, the total electron current per unit light output is smaller than in a conventional cathodoluminescent light source, which simplifies the design of the light source.

As it is easy to vary the emission current in a field emission cathode and/or the avalanche amplification by varying an avalanche voltage the light source may readily be dimmed.

BRIEF DESCRIPTION OF THE DRAWINGS

Further features and advantages of the present invention will be evident from the following detailed description of embodiments given below and the accompanying Figures, which are given by way of illustration only, and thus, are not limitative of the present invention, wherein.

DETAILED DESCRIPTION OF EMBODIMENTS

Figure 1A:
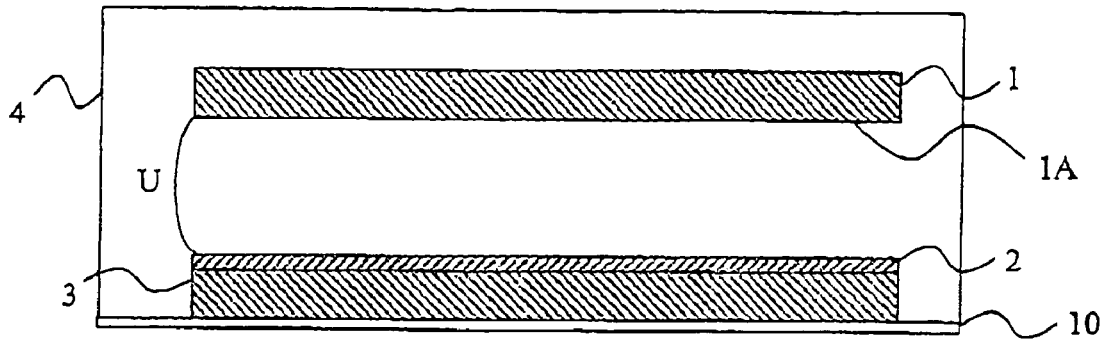
FIGS. 1–6 are cross-sectional side views of light sources according to six different embodiments of the present invention.

A first embodiment of the present invention will now be described with reference to FIGS. 1A and 1B.

A planar cathodoluminescent light source comprises a planar cathode 1, a planar anode 2 parallel to the cathode 1 and a fluorescent layer 3 inside a casing 4. The casing 4 has a window 10 to allow light to emerge from the light source. The fluorescent layer 3 is arranged on the inside of the window 10, and the anode 2 is arranged on a surface of the fluorescent layer 3, which faces the cathode 1.

The casing 4 is hermetically sealed and filled with a gas suitable for electron avalanche amplification. A diffuser may be arranged outside the casing 4 (not illustrated). A diffuser provides leveling of luminous intensity to compensate for different luminous intensity from different areas of the light source.

The planar cathode 1 may be any type of cathode that can be stimulated to emit electrons from its surface 1A facing the anode 2. It may have a smooth or an irregular surface. Irregularities in the surface 1A may e.g. be formed by irradiating the surface with laser light, etching, mechanical roughening, or deposition of material producing irregular shapes such as e.g. carbon nanotubes, fulerenes, etc. Emission of electrons is provided either by heating the cathode 1, causing the electrons to be thermally emitted, or by applying a strong electric field in the vicinity of the surface of the cathode 1 causing electrons to be emitted by field emission. It is further possible to heat a field emission cathode to provide emission of electrons by applying a lower electric field, as compared to a non-heated field emission cathode.

The planar anode 2 is permeable to high-energy electrons, to allow such electrons to penetrate the anode and bombard the fluorescent layer 3. The planar anode 2 may e.g. be a thin foil or may have a meshed shape.

Figure 1B:
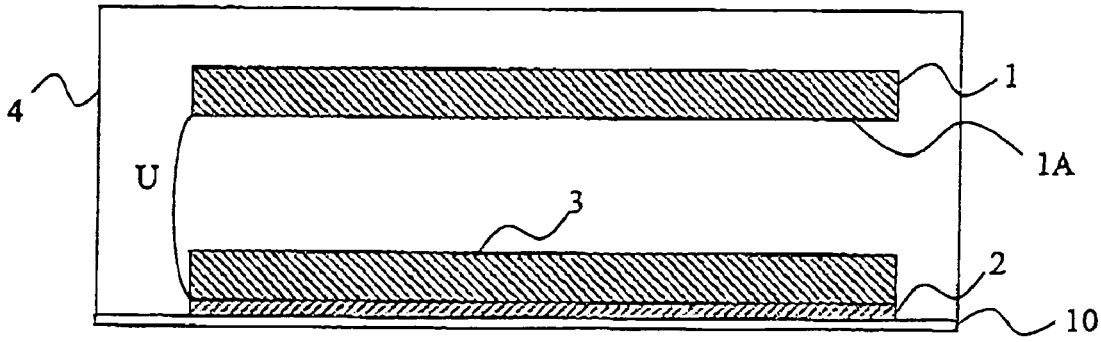

Alternatively, the anode 2 is arranged between the fluorescent layer 3 and the casing 4 as illustrated in FIG. 1B. The planar anode 2 has then to be transparent to light and may be made of a transparent conductor or may have a meshed shape. However, the anode has not to be transparent to electrons. The anode 2 can in this case be part of the casing 4 where e.g. the casing 4 can be made of a conductive material, e.g. conductive glass or plastic.

The fluorescent layer 3 may consist of a single material or a mixture of materials, e.g. a mixture of $Y_2O_2S$:Eu, ZnS:Cu;Al and ZnS:Cl.

A gas suitable for electron avalanche amplification may e.g. be any noble gas, nitrogen or a noble gas mixed with a hydrocarbon gas such as 90% argon and 10% methane. The gas is preferably at atmospheric pressure, but may be at under- or overpressure, preferably in the range 0.001–20 atm.

A voltage U is, during use, applied between the anode 2 and the cathode 1. The voltage U should be high enough to cause electrons to be emitted from the cathode 1 in the case of field emission. The voltage U should in all cases be high enough to avalanche amplify the electrons in the gas. The avalanche amplified electrons are accelerated towards the anode 2 and thus the fluorescent layer 3. The electrons are absorbed in the fluorescent layer 3 and thus excite the fluorescent material thereof. During relaxation the fluorescent layer 3 emits bright visible light.

As during the avalanche amplification, besides electrons, also UV light is emitted that may stimulate the fluorescent material, causing it to emit light. This physical process may be used together smith the electron bombardment or separately for producing the light.

An advantage of using avalanche amplification in a gas is that electrons emitted from the cathode are accelerated by an electric field between the cathode 1 and the anode 2 and ionize the gas and new electrons are emitted from the gas, which in turn are accelerated and ionize the gas further. Thus, the main part of the electrons providing light is derived from the gas and not from the cathode, which lessen the wear of the cathode. The gas functions as a catalyst as positive ions formed during the ionization of the gas drift toward the cathode where they are neutralized and revert to the gas.

Using a distance of 1 mm between the anode 2 and the cathode 1 in a gas of argon and methane at a pressure of 1 atm a voltage of typically 1000 V is sufficient to emit electrons from the cathode 1, and to avalanche amplify the emitted electrons.

The dimensions of the light source may vary tremendously, depending on the intended use and light source may be produced having quadratic to very elongated light emitting surfaces.

A second embodiment of the present invention will next be described with reference to FIG. 2. This second embodiment is identical with the first embodiment apart from the following.

Figure 2:
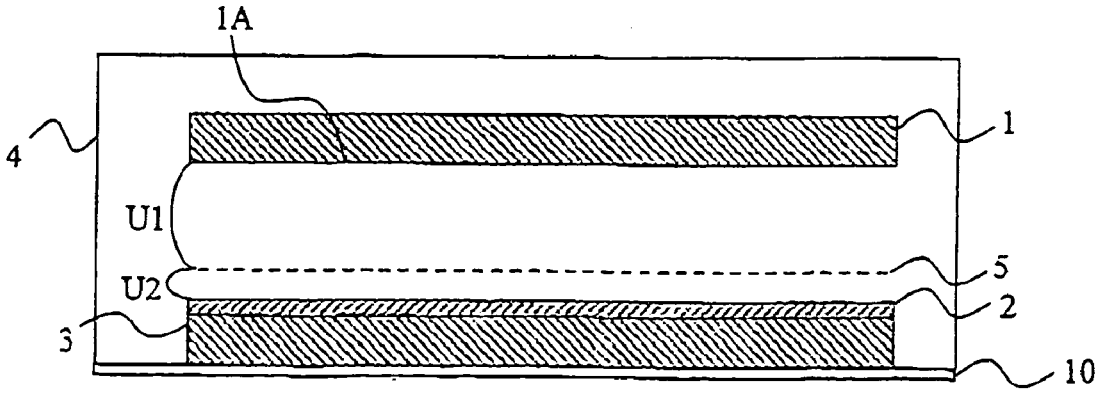

The planar cathodoluminescent light source of FIG. 2 further comprises a modulator electrode 5 positioned between the anode 2 and the cathode 1, preferably closer to the anode 2 than to the cathode 1. Preferably, the modulator electrode 5 has a meshed shape to allow electrons to pass through.

An electric field necessary to emit an electron from a cathode through field emission is normally lower than an electric field for avalanche amplification of electrons. Thus, by providing the modulator electrode 5 close to the anode 2 a sufficiently high electric field may be obtained without applying very high voltage for the electrons emitted from the cathode 1 to be avalanche amplified close to the anode 2.

By providing a modulator electrode in the light source the positive ions formed during the ionization of the gas drift toward the modulator electrode where they are neutralized and revert to the gas.

A first voltage U1 is, during use, applied between the modulator electrode 5 and the cathode 1, and causes emission of electrons from the cathode 1 and/or acceleration of emitted electrons from cathode 1. A second voltage U2 is applied between the anode 2 and the modulator electrode 5, and is high enough to avalanche amplify the emitted electrons in the gas and give them sufficiently high kinetic energy such that the avalanche amplified electrons are capable to penetrate the anode 2 and bombard the fluorescent layer 3, which in response thereto emits light.

Figure 3:
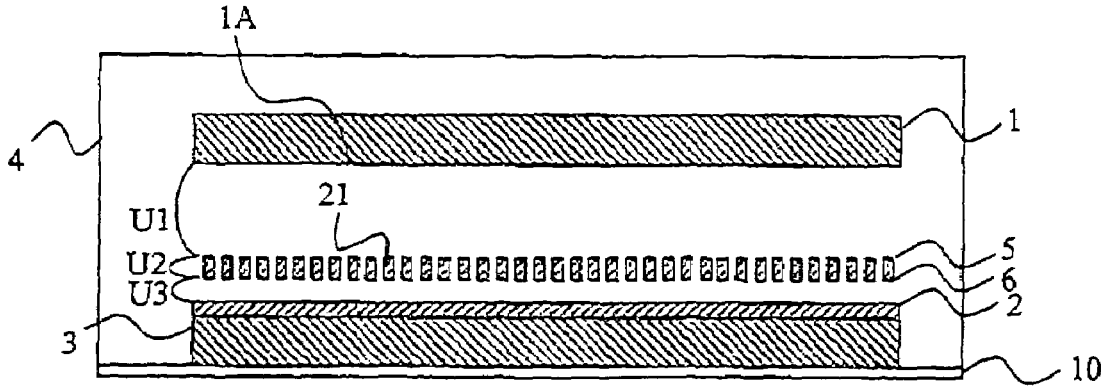

Next, a third embodiment of the present invention is described with reference to FIG. 3. This third embodiment is identical with the second embodiment except for the following.

The planar cathodoluminescent light source further comprises an avalanche electrode 6 positioned between the anode 2 and the modulator electrode 5, preferably closer to the modulator electrode 5 than to the anode 2. Preferably, the avalanche electrode 6 has a meshed shape to allow electrons to pass through. Gratings may be used to make up the meshed shapes of the modulator electrode 5 and the avalanche electrode 6. The electrodes 5 and 6 should preferably be positioned parallel with each other and having apertures aligned with each other.

A dielectric 21, such as a polyamide film, may be positioned between the modulator electrode 5 and the avalanche electrode 6 to keep them apart at a well defined distance. The dielectric 21 may have apertures precisely matching the apertures of the gratings or have apertures that are wider or narrower than the apertures of the gratings 5 and 6. When a dielectric 21 is utilized to stabilize the electrodes 5 and 6 the gratings of the electrodes may be manufactured by means of metallizing the dielectric 21.

By providing a modulator electrode and an avalanche electrode in the light source the positive ions formed during the ionization of the gas drift toward the modulator electrode and the avalanche electrode, respectively, where they are neutralized and revert to the gas.

A first voltage U1 is, during use, applied between the modulator electrode 5 and the cathode 1, and causes emission of electrons from the cathode 1, and/or acceleration of emitted electrons from the cathode 1. A second voltage U2 is applied between the avalanche electrode 6 and the modulator electrode 5 and accelerates the emitted electrons in the gas, possibly the voltage U2 may be high enough to achieve avalanche amplification of the emitted electrons. A third voltage U3 is applied between the anode 2 and the avalanche electrode 6, and is high enough to either further avalanche amplify the previously amplified electrons or to drift the electrons towards and through the anode 2 and bombard the fluorescent layer 3, which in response thereto emits light.

Provided that the second voltage U2 avalanche amplifies the electrons, the third voltage U3 may have a reversed electrical field, collecting the electrons on the avalanche electrode 6 instead of on the anode 2. In the gap between the electrodes 5 and 6 UV-light is formed by means of the avalanche effect, which illuminate the fluorescent layer 3 without bombarding it with electrons. This is particularly advantageous when the anode 2 is positioned between the fluorescent layer 3 and the window 10 or when the anode 2 is part of the casing 4.

Figure 4A:
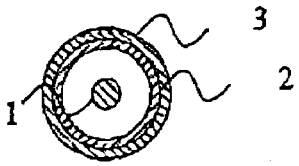
Figure 4B:
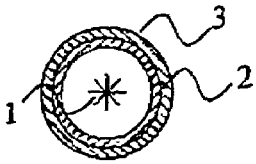

A fourth embodiment of the present invention will next be described with reference to FIGS. 4A and 4B.

A cylindrical cathodoluminescent light source comprises a rod cathode 1 having a circular cross section, a cylindrical anode 2 having an annular cross section and a cylindrical fluorescent substance 3 inside a casing (not illustrated). The casing has a window to allow light to emerge from the light source. The fluorescent layer 3 may be arranged to cover the inside of the window. The anode 2 is preferably arranged on the cylindrical fluorescent substance 3 facing the cathode 1.

The casing is hermetically sealed and filled with a gas suitable for electron avalanche amplification. A diffuser (not illustrated) may be arranged outside the casing, to provide leveling of luminous intensity to compensate for different luminous intensity from different areas of the light source.

The rod cathode 1 may have a surface similar to the cathode surface described above in connection with the first embodiment, i.e. smooth or irregular. Alternatively, the cathode 1 may consist of a plurality of fibers, e.g. carbon fibers, carbon nanotubes, fulerenes etc, extending radially, thus forming a plurality of disks forming a rod-shape as illustrated in FIG. 4B.

The anode 2 is permeable to high-energy electrons, allowing such electrons to penetrate the anode 2 and bombard the fluorescent cylindrical layer 3. The anode 2 may e.g. be a thin foil or have a meshed shape.

Distances, fluorescent substance, gas contents and applied voltages may be identical with those of the first embodiment described above.

This fourth embodiment has been described as having cylindrical symmetry, but may alternatively have spherical symmetry.

Further, this embodiment may include a modulator electrode as described in the second embodiment, and yet further include an avalanche electrode and a dielectric as described in the third embodiment.

Figure 5:
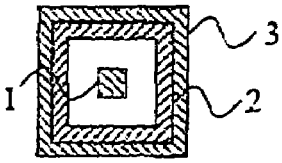

A fifth embodiment of the present invention, illustrated in FIG. 5, is identical with the fourth embodiment except for that the cathode 1 has a square cross section and that the anode has a square-shaped cross section 2.

Figure 6:
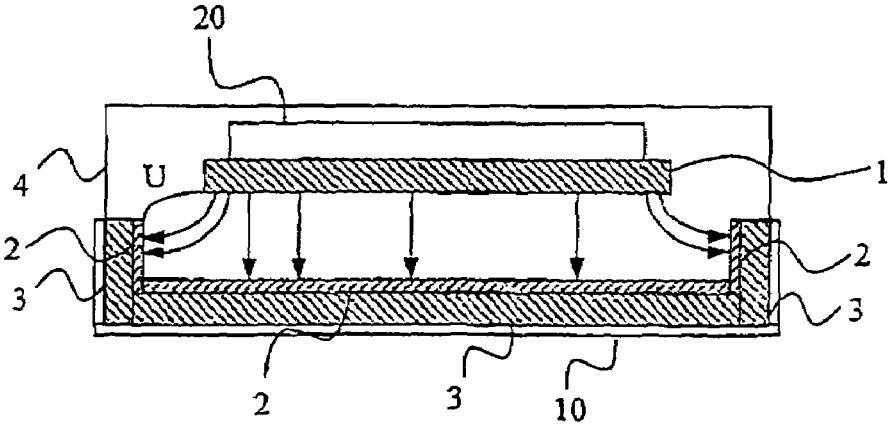

A sixth embodiment of the present invention will next be described with reference to FIG. 6. This sixth embodiment is identical with the first embodiment apart from the following.

The cathode 1 is heated by means of a heater 20 to boost the emission of electrons from the cathode 1.

The anode 2 is not planar, but has a surface partly parallel with the cathode 1 and partly perpendicular to the cathode 1. Thus, providing an electrical field (illustrated by arrows in FIG. 6) causing emission of light in non-parallel planes.

Further, this embodiment may include a modulator electrode as being comprised in the second embodiment, and may yet further include an avalanche electrode and a dielectric as described in connection with the third embodiment.

Different types of lamp housings will next be described with reference to FIG. 7–9. A diffuser as described above may be included in such a lamp housing.

Figure 7:
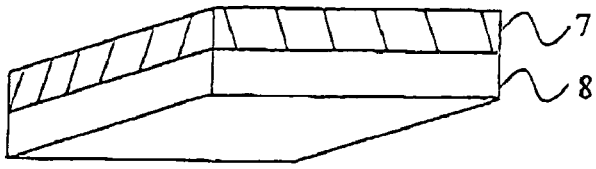
FIGS. 7–9 are perspective views of three different lamp housings which may be used together with the light sources of the present invention.

A first type of lamp housing is illustrated in FIG. 7, and includes a lamp fitting part 7 and a glass part 8. The lamp fitting part 7 is non-transparent and holds a light source as e.g. one of the first to third embodiments or the sixth embodiment within the lamp housing and includes means to fix the lamp housing to a wall, a ceiling or other support. The lamp housing may also house the electronics associated with the light source. The glass part 8 is transparent or translucent and is arranged to protect the light source and to admit light to be transmitted from the light source.

Figure 8:
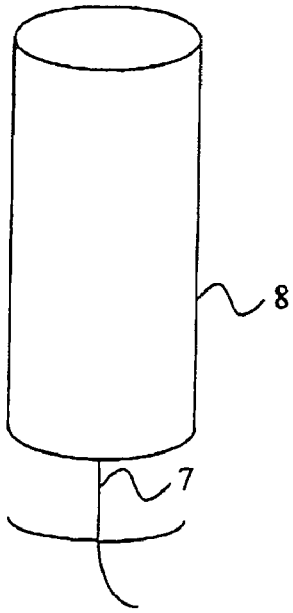

Another design of lamp housing is illustrated in FIG. 8, and includes a lamp fitting part 7 and a glass part 8. The lamp fitting part 7 is arranged to hold a light source as e.g. the fourth or fifth embodiment in the lamp housing and the lamp housing. The glass part 8 is transparent, translucent or non-transparent radial to an axis of symmetry of the cylinder and open upwards and/or downwards.

Figure 9:
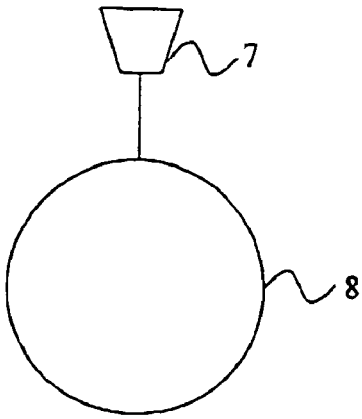

Yet another design of lamp housing is illustrated in FIG. 9, and includes a lamp fitting part 7 and a glass part 8. The lamp fitting part 7 is non-transparent and arranged to hold a light source as e.g. the spherical alternative of the fourth embodiment in the lamp housing and the lamp housing to a ceiling. The glass part 8 is transparent or translucent.

All the embodiments described above may easily be provided with a dimmer. By varying a voltage applied to the light source the emission current and/or the avalanche amplification may be varied, which in turn varies the intensity of the emitted light from the light source.

It will be obvious that the present invention may be varied in a plurality of ways. Such variations are not to be regarded as departure from the scope of the present invention.

The invention claimed is:

1. An arrangement for emitting light comprising:

a hermetically sealed casing including a transparent or translucent window (10);

a layer of a fluorescent substance arranged within said casing covering at least a major part of the window;

an electron emitting cathode arranged within said casing for emission of electrons; and an anode;

wherein said casing is filled with a gas suitable for electron avalanche amplification;

said cathode and anode are, during use, held at electric potentials such that said emitted electrons are accelerated and avalanche amplified in said gas; and said layer is arranged to emit light through said window in response to being bombarded by avalanche amplified electrons and/or light as being in response to being exposed to ultraviolet as being emitted in the gas due to interactions between the avalanche amplified electrons and the gas.

2. The arrangement as claimed in claim 1, whereing said cathode is a thermal emission cathode and wherein said arrangement includes heater means for heating said cathode to thereby emit electrons.

3. The arrangement as claimed in claim 1, wherein said cathode is a field emission cathode, and wherein said anode is, during use, held at an electric potential higher than that of said cathode such that electrons from said cathod can be emitted.

4. The arrangement as claimed in claim 1, wherein said anode is, during use, held at an electric potential higher than that of said cathode for creating emission of electrons from said cathode and wherein said arrangement includes heater means for heating said cathode to thereby facilitate creating said emission of electrons.

5. The arrangement as claimed in claim 3, comprising a modulator electrode arranged between said anode and said cathode, said modulator electrode being, during use, held at an electric potential higher than that of said cathode and lower than that of said anode for creating a first electric field between said cathode and said modulator electrode for said emission of electrons and for creating a second electric field between said modulator electrode and said anode for said avalanche amplification of emitted electrons.

6. The arrangement as claimed in claim 5, wherein said modulator electrode is arranged closer to said anode than to said cathode.

7. The arrangement as claimed in claim 5, comprising an avalanche electrode arranged between' said modulator electrode and said anode, said avalanche electrode being, during use, held at an electric potential higher than that of said modulator electrode and lower than that of said anode for creating said avalanche amplification in two different steps of different electrical fields.

8. The arrangement as claimed in claim 5, comprising an avalanche electrode arranged between said modulator electrode and said anode, said avalanche electrode being, during use, held at an electric potential higher than that of said modulator electrode and higher than that of said anode for collecting said avalanche amplified electrons on said avalanche electrode.

9. The arrangement as claimed in claim 7, wherein a dielectric (21) is arranged between said modulator electrode and said avalanche electrode for keeping said modulator electrode and said avalanche electrode at a well defined distance.

10. The arrangement as claimed in claim 9, wherein said modulator electrode and said avalanche electrode are provided as metallizations on said dielectric.

11. The arrangement as claimed in claim 7, wherein said avalanche electrode is arranged closer to said anode than to said modulator electrode.

12. The arrangement as claimed in claim 1, wherein said anode is arranged on said fluorescent layer facing said cathode and wherein said anode is permeable to said avalanche amplified electrons.

13. The arrangement as claimed in claim 1, wherein said anode is arranged between said fluorescent layer and said casing and wherein said anode is transparent to light.

14. The arrangement as claimed in claim 1, wherein said cathode has an irregular surface facing said anode.

15. The arrangement as claimed in claim 1, comprising a plurality of cathodes.

16. The arrangement as claimed in claim 1, wherein said fluorescent substance comprises a single material or a mixture of materials, such as a mixture of $Y_20_2S$:Eu, ZnS:Cu; Al and ZnS:Cl.

17. The arrangement as claimed in claim 1, wherein said anode and said cathode have planar, cylindrical or spherical symmetries.

18. The arrangement as claimed in claim 1, wherein said casing is surrounded by a diffuser.

19. The arrangement as claimed in claim 1, comprising electronics allowing said potentials to be changed to thereby change the light emitted from said fluorescent layer.

20. A two part lamp housing comprising an arrangement as claimed in claim 1, a holder supporting said arrangement and a diffuser surrounding said arrangement.

21. A method for emitting light, in a device comprising: a gas suitable for electron avalanche amplification, a fluorescent substances, an electron emitting cathode and an anode, wherein:

holding said anode and said cathode at electrical potentials such that emission of electrons from said cathode is obtained, electrons emitted from said cathode are avalanche amplified in said gas, and said avalanche amplified electrons are arranged to bombard said fluorescent substance, which fluorescent substance emits light in response to being bombarded by said avalanche amplified electrons and/or in response to being exposed to ultraviolet light as being emitted in the gas due to interactions between the avalanche amplified electrons and the gas.

22. The method as claimed in claim 21, wherein said device further comprises a modulator electrode and said method comprises the following step:

holding said modulator electrode at an electrical potential higher than that of said cathode and lower than that of said anode such that said emission of electrons from said cathode and said avalanche amplification of said emitted electrons are performed at two different electrical fields.

23. The method as claimed in claim 22, wherein said device further comprises an avalanche electrode and said method comprises the following step:

holding said avalanche electrode at an electrical potential higher than that of said modulator electrode and lower than that of said anode such that said avalanche amplification is performed in two steps of different electrical fields.

24. The method as claimed in claim 22, wherein said device further comprises an avalanche electrode and said method comprises the following step:

holding said avalanche electrode at, an electrical potential higher than that of said modulator electrode and higher than that of said anode such that said avalanche amplified electrons are collected on said avalanche electrode.

25. The method as claimed in claim 21, comprising the further step of altering said potentials to thereby alter the light emitted from said fluorescent substance.

26. A method for emitting light, in a device comprising: a gas suitable for electron avalanche amplification, a fluorescent substance, an electron emitting cathode and an anode, wherein:

heating said cathode such that emission of electrons from said cathode is obtained; and holding said anode and said cathode at electrical potentials such that electrons emitted from said cathode are avalanche amplified in said gas, and said avalanche amplified electrons are arranged to bombard said fluorescent substance, which fluorescent substance emits light in response to being bombarded by said avalanche amplified electrons and/or in response to being exposed to ultraviolet light as being emitted in the gas due to interactions between the avalanche amplified electrons and the gas.

27. The method as claimed in claim 26, wherein said device further comprises a modulator electrode and said method comprises the following step:

holding said modulator electrode at an electrical potential higher than that of said cathode and lower than that of said anode such that said avalanche amplification of said emitted electrons are performed in two steps of different electrical fields.

28. The method as claimed in claim 21, wherein said device is surrounded by a diffuser, such that irregularities in light distribution of emitted light from said device is evened out.

* * * * *